US011576837B2

(12) United States Patent
Delgado

(10) Patent No.: US 11,576,837 B2
(45) Date of Patent: Feb. 14, 2023

(54) MULTI-ZONAL ROLLER AND METHOD OF USE THEREOF

(71) Applicant: Fitness Anywhere LLC, San Francisco, CA (US)

(72) Inventor: Mauricio Hernan Delgado, San Anselmo, CA (US)

(73) Assignee: JFXD TRX ACQ LLC, Delray Beach, FL (US)

( * ) Notice: Subject to any disclaimer, the term of this patent is extended or adjusted under 35 U.S.C. 154(b) by 565 days.

(21) Appl. No.: 16/592,337

(22) Filed: Oct. 3, 2019

(65) Prior Publication Data

US 2021/0100719 A1 Apr. 8, 2021

(51) Int. Cl.
*A61H 15/00* (2006.01)

(52) U.S. Cl.
CPC ..... *A61H 15/0092* (2013.01); *A61H 15/00* (2013.01); *A61H 2015/0014* (2013.01); *A61H 2201/169* (2013.01)

(58) Field of Classification Search
CPC ..... A61H 15/0092; A61H 2015/0014; A61H 15/0078; A61H 15/0085; A61H 15/02
See application file for complete search history.

(56) References Cited

U.S. PATENT DOCUMENTS

| | | | |
|---|---|---|---|
| 644,109 | A | 2/1900 | Stonebridge |
| 681,331 | A | 8/1901 | Milkman |
| 693,063 | A | 2/1902 | Preston |
| 707,508 | A | 8/1902 | Gibbs |
| 731,693 | A | 6/1903 | Lennox |
| 769,463 | A | 9/1904 | Blanchard |
| 1,611,811 | A | 12/1926 | Brickey |
| 1,688,764 | A | 10/1928 | Trankowski et al. |
| 1,748,425 | A | 2/1930 | Odell |
| 1,817,077 | A | 8/1931 | Gustaveson |
| 1,882,490 | A | 10/1932 | Falck |
| 2,213,482 | A | 9/1940 | Avery |
| 2,286,324 | A | 6/1942 | Wentz |
| 2,446,099 | A | 7/1948 | Niblack |
| 2,939,455 | A | 6/1960 | Arnold |
| 3,003,497 | A | 10/1961 | Nunes |

(Continued)

FOREIGN PATENT DOCUMENTS

| | | | |
|---|---|---|---|
| AU | 3986572 | A | 9/1973 |
| AU | 1052176 | A | 7/1977 |

(Continued)

OTHER PUBLICATIONS

International Search Report for International App. No. PCT/US20/54038 dated Jan. 6, 2021.

(Continued)

*Primary Examiner* — Michael J Tsai
(74) *Attorney, Agent, or Firm* — Duane Morris LLP

(57) ABSTRACT

The present invention generally relates a multi-zonal and non-circular roller with several different zones along the periphery of the roller's outer surface and more specifically a roller having a non-circular internal area, a non-regular external surface covered by a series of multiple shape and angles designed to include to offer a user different types of resistance and muscle relief, including a point for the management of a myofascial trigger point.

14 Claims, 6 Drawing Sheets

(56) References Cited

U.S. PATENT DOCUMENTS 3,067,738 A 12/1962 Karlik
3,104,413 A 9/1963 Nelson
3,389,699 A 6/1968 Mathers
3,415,514 A 12/1968 Weihs
3,662,748 A 5/1972 Thurman
3,955,646 A 5/1976 Luebkemann
3,970,078 A 7/1976 Rogers, Jr.
3,978,181 A 8/1976 Vahie
4,002,163 A 1/1977 Jackson, Jr.
D243,557 S 3/1977 Kientz
4,030,178 A 6/1977 Luebkemann
4,989,585 A 2/1991 Auker
5,020,518 A 6/1991 Spears et al.
5,029,848 A 7/1991 Sleamaker
5,062,385 A 11/1991 Nishio et al.
5,241,343 A 8/1993 Nishio
5,431,613 A 7/1995 Singleton et al.
5,432,591 A 7/1995 Geleynse
5,451,194 A 9/1995 Harrigan
D364,230 S 11/1995 Schweisfurth
5,501,658 A 3/1996 Frye
5,521,685 A 5/1996 Barnes et al.
5,599,266 A 2/1997 Landl et al.
5,733,233 A 3/1998 Webber
5,971,891 A 10/1999 Humphrey
5,980,434 A 11/1999 Webber
6,200,283 B1 * 3/2001 Groen ..... A61H 15/00 601/121
6,245,000 B1 6/2001 Saakian et al.
D454,929 S 3/2002 Huang
6,368,253 B1 4/2002 Harrigan
D511,007 S 10/2005 Ghedin
D527,831 S 9/2006 Hong
D535,752 S 1/2007 Smith
D546,402 S 7/2007 Sonnier
D549,834 S 8/2007 Huang
D559,450 S 1/2008 Fisher
7,364,535 B1 4/2008 Rosenow et al.
7,481,783 B1 1/2009 Kelley
D617,467 S 6/2010 Dworzan
7,753,827 B1 7/2010 Emick
7,918,774 B2 4/2011 Dye
D639,974 S 6/2011 Kurosu
8,002,682 B2 8/2011 Dye
D648,034 S 11/2011 Rice
D656,621 S 3/2012 Matsushita
D657,065 S 4/2012 Matsushita
D657,830 S 4/2012 Guarrasi
D660,450 S 5/2012 Johnson
D662,601 S 6/2012 Matsushita
D666,304 S 8/2012 Matsushita
D668,771 S 10/2012 Matsushita
D669,998 S 10/2012 Matsushita
D674,500 S 1/2013 Matsushita
8,453,831 B1 6/2013 Thimmel
D688,380 S 8/2013 Nelson
D688,384 S 8/2013 Soliman
D693,934 S 11/2013 Lin
D700,346 S 2/2014 Palizzi et al.
D702,362 S 4/2014 Thorne et al.
D704,852 S 5/2014 Yang
D721,183 S 1/2015 Mallory
D724,750 S 3/2015 Taylor
D732,680 S 6/2015 Taylor
D734,480 S 7/2015 Jones
D739,900 S 9/2015 Smith
D754,868 S 4/2016 Hendrickson
D755,304 S 5/2016 Ackerman
9,345,921 B2 5/2016 Dye
D762,309 S 7/2016 Cohen
D764,066 S 8/2016 Somjee
D777,340 S 1/2017 Nelson
9,539,167 B2 1/2017 Dye
D785,103 S 4/2017 Townsend
D788,313 S 5/2017 Lawrie
9,656,112 B2 5/2017 Dye
9,668,933 B1 6/2017 Johnson
D794,814 S 8/2017 Higgins et al.
D796,053 S 8/2017 Phillips
D800,329 S 10/2017 Cheng
D800,330 S 10/2017 Loos
D809,612 S 2/2018 Ganea
D818,139 S 5/2018 Marshall
D818,598 S 5/2018 Cox
D825,695 S 8/2018 Kim
D829,920 S 10/2018 Carpinelli
D830,569 S 10/2018 Solomon
D833,027 S 11/2018 Viner et al.
D833,635 S 11/2018 Chen
D838,376 S 1/2019 Liu
D841,827 S 2/2019 Zedaker
D842,487 S 3/2019 Matsushita
D843,001 S 3/2019 Davis et al.
D843,002 S 3/2019 Yarborough et al.
D843,522 S 3/2019 Miklavc et al.
10,220,245 B1 3/2019 Halen
2002/0018676 A1 2/2002 Hirai et al.
2002/0065176 A1 5/2002 LaFond
2003/0225351 A1 12/2003 Wu
2004/0030274 A1 2/2004 Wu
2005/0187498 A1 8/2005 Miller
2005/0209072 A1 9/2005 Sheron
2005/0209074 A1 9/2005 Barrows
2006/0142677 A1 6/2006 Perez
2007/0254757 A1 11/2007 Wang
2008/0199043 A1 8/2008 Forsgren
2008/0310887 A1 12/2008 Nogami et al.
2009/0104591 A1 4/2009 Panetta
2009/0112137 A1 * 4/2009 Lamore ..... A63B 22/20 601/112
2009/0131234 A1 5/2009 Dye
2009/0293227 A1 12/2009 Wang
2009/0298651 A1 12/2009 Stewart
2010/0113992 A1 5/2010 Godfrey et al.
2010/0210435 A1 8/2010 Isaac
2010/0274165 A1 10/2010 Evans
2011/0105286 A1 5/2011 Dye
2011/0152035 A1 6/2011 Wahl
2011/0177926 A1 7/2011 Kusano et al.
2011/0188900 A1 8/2011 Kusano et al.
2011/0204538 A1 8/2011 Drury
2012/0259257 A1 10/2012 Nelson
2012/0283077 A1 11/2012 Cranke
2012/0310125 A1 12/2012 Hall
2012/0323150 A1 12/2012 Johnston
2013/0090220 A1 * 4/2013 Bertram ..... A61H 7/00 482/139
2013/0158455 A1 6/2013 Ruschmeyer et al.
2013/0261517 A1 10/2013 Rodgers
2014/0114221 A1 4/2014 Indermill et al.
2014/0128786 A1 * 5/2014 Ross ..... A61H 15/0092 601/118
2014/0179495 A1 6/2014 Payan
2014/0228723 A1 8/2014 Cockerill et al.
2014/0371639 A1 12/2014 Diecidue
2015/0045707 A1 2/2015 Selvaggio
2015/0057135 A1 2/2015 Cranke et al.
2015/0080773 A1 3/2015 Godfrey et al.
2015/0133835 A1 * 5/2015 Fadil ..... A61H 7/001 601/118
2015/0209220 A1 7/2015 Lin
2015/0257969 A1 9/2015 Shannon
2015/0265486 A1 9/2015 Fiore
2015/0343256 A1 12/2015 Coompool
2016/0058656 A1 3/2016 Harvel
2016/0101309 A1 4/2016 Schreiber et al.
2016/0113841 A1 4/2016 Godfrey et al.
2016/0158096 A1 6/2016 Godfdrey
2016/0235619 A1 8/2016 Yeh
2016/0302989 A1 10/2016 Loduca
2016/0310351 A1 10/2016 Nelson
2016/0310352 A1 10/2016 Chen
2016/0331628 A1 11/2016 Kuo
2017/0020771 A1 1/2017 Shannon

(56) References Cited

U.S. PATENT DOCUMENTS

| | | | |
|---|---|---|---|
| 2017/0020773 | A1 | 1/2017 | Ross |
| 2017/0027808 | A1 | 2/2017 | Castiglione |
| 2017/0065482 | A1 | 3/2017 | Downare |
| 2017/0071817 | A1 | 3/2017 | Sanchez |
| 2017/0080283 | A1 | 3/2017 | Harman |
| 2017/0087048 | A1 | 3/2017 | Cohen |
| 2017/0156479 | A1 | 6/2017 | Kwong |
| 2017/0202729 | A1 | 7/2017 | Lin |
| 2017/0202730 | A1 | 7/2017 | Lin |
| 2017/0216133 | A1 | 8/2017 | Yih |
| 2017/0216136 | A1 | 8/2017 | Gordon |
| 2017/0216659 | A1 | 8/2017 | Lalaoua |
| 2017/0246077 | A1 | 8/2017 | Dye |
| 2018/0021211 | A1 | 1/2018 | Suokas |
| 2018/0049940 | A1 | 2/2018 | Cannon |
| 2018/0049941 | A1 | 2/2018 | Venezia |
| 2018/0078446 | A1 | 3/2018 | Taylor |
| 2018/0133096 | A1 | 5/2018 | Loos |
| 2018/0207055 | A1 | 7/2018 | Davis et al. |
| 2018/0256442 | A1 | 9/2018 | Lee |
| 2018/0289581 | A1 | 10/2018 | Zook |
| 2018/0326254 | A1 | 11/2018 | Earls |
| 2018/0339216 | A1 | 11/2018 | Gencarelii |
| 2018/0353371 | A1 | 12/2018 | Shikahama |
| 2019/0009130 | A1 | 1/2019 | Safar |
| 2019/0021941 | A1 | 1/2019 | Jeong |
| 2020/0030181 | A1* | 1/2020 | Lin ..... A61H 1/00 |

FOREIGN PATENT DOCUMENTS

| | | | |
|---|---|---|---|
| AU | 2017239536 | A1 | 10/2017 |
| AU | 2017101795 | A4 | 2/2018 |
| AU | 2018100056 | A4 | 2/2018 |
| CA | 43249 | S | 6/1893 |
| CA | 43483 | S | 7/1893 |
| CA | 128263 | S | 1/1910 |
| CA | 128261 | S | 9/1910 |
| CA | 128262 | S | 9/1910 |
| CA | 145760 | S | 2/1913 |
| CA | 171551 | S | 2/1916 |
| CA | 687783 | A | 6/1964 |
| CA | 1004559 | A | 2/1977 |
| CA | 2204191 | A1 | 11/1998 |
| CA | 2434904 | A1 | 1/2005 |
| CA | 2889815 | A1 | 4/2015 |
| CA | 162002 | S | 10/2017 |
| CA | 2996986 | A1 | 2/2018 |
| CA | 177196 | S | 4/2018 |
| CA | 178528 | S | 8/2018 |
| CA | 3027486 | A1 | 12/2018 |
| CA | 3013391 | A1 | 2/2019 |
| CA | 181972 | S | 3/2019 |
| CH | 667694 | A5 | 10/1988 |
| CH | 700544 | A2 | 9/2010 |
| CN | 101628479 | A | 1/2010 |
| CN | 101968614 | A | 2/2011 |
| CN | 102414626 | A | 4/2012 |
| CN | 202214049 | U | 5/2012 |
| CN | 102579224 | A | 7/2012 |
| CN | 102617020 | A | 8/2012 |
| CN | 202407292 | U | 9/2012 |
| CN | 202528275 | U | 11/2012 |
| CN | 202537931 | U | 11/2012 |
| CN | 202553730 | U | 11/2012 |
| CN | 202575464 | U | 12/2012 |
| CN | 102863139 | A | 1/2013 |
| CN | 202673911 | U | 1/2013 |
| CN | 202682306 | U | 1/2013 |
| CN | 103175395 | A | 6/2013 |
| CN | 202961132 | U | 6/2013 |
| CN | 203060253 | U | 7/2013 |
| CN | 203122967 | U | 8/2013 |
| CN | 203269747 | U | 11/2013 |
| CN | 203291190 | U | 11/2013 |
| CN | 203307622 | U | 11/2013 |
| CN | 203323549 | U | 12/2013 |
| CN | 103520902 | A | 1/2014 |
| CN | 203438422 | U | 2/2014 |
| CN | 203441116 | U | 2/2014 |
| CN | 203447744 | U | 2/2014 |
| CN | 203493889 | U | 3/2014 |
| CN | 103739187 | A | 4/2014 |
| CN | 203540022 | U | 4/2014 |
| CN | 203555935 | U | 4/2014 |
| CN | 203563949 | U | 4/2014 |
| CN | 203564496 | U | 4/2014 |
| CN | 203564712 | U | 4/2014 |
| CN | 203576375 | U | 5/2014 |
| CN | 203591432 | U | 5/2014 |
| CN | 203789799 | U | 8/2014 |
| CN | 203841999 | U | 9/2014 |
| CN | 203899094 | U | 10/2014 |
| CN | 203899095 | U | 10/2014 |
| CN | 203915765 | U | 11/2014 |
| CN | 104193143 | A | 12/2014 |
| CN | 203976610 | U | 12/2014 |
| CN | 203992331 | U | 12/2014 |
| CN | 204039237 | U | 12/2014 |
| CN | 204048838 | U | 12/2014 |
| CN | 204072735 | U | 1/2015 |
| CN | 104367457 | A | 2/2015 |
| CN | 104399223 | A | 3/2015 |
| CN | 104399361 | A | 3/2015 |
| CN | 204181873 | U | 3/2015 |
| CN | 204233958 | U | 4/2015 |
| CN | 204246023 | U | 4/2015 |
| CN | 204261009 | U | 4/2015 |
| CN | 104645561 | A | 5/2015 |
| CN | 104656839 | A | 5/2015 |
| CN | 204319227 | U | 5/2015 |
| CN | 204329590 | U | 5/2015 |
| CN | 204367260 | U | 6/2015 |
| CN | 204485178 | U | 7/2015 |
| CN | 204485280 | U | 7/2015 |
| CN | 105062189 | A | 11/2015 |
| CN | 105080071 | A | 11/2015 |
| CN | 204766415 | U | 11/2015 |
| CN | 204798326 | U | 11/2015 |
| CN | 105107133 | A | 12/2015 |
| CN | 105107150 | A | 12/2015 |
| CN | 105107152 | A | 12/2015 |
| CN | 204814743 | U | 12/2015 |
| CN | 204840187 | U | 12/2015 |
| CN | 204890532 | U | 12/2015 |
| CN | 204890533 | U | 12/2015 |
| CN | 204891083 | U | 12/2015 |
| CN | 105287092 | A | 2/2016 |
| CN | 205083952 | U | 3/2016 |
| CN | 205107489 | U1 | 3/2016 |
| CN | 105479660 | A | 4/2016 |
| CN | 205126730 | U | 4/2016 |
| CN | 105544145 | A | 5/2016 |
| CN | 105561540 | A | 5/2016 |
| CN | 105561541 | A | 5/2016 |
| CN | 105596193 | A | 5/2016 |
| CN | 205234744 | U | 5/2016 |
| CN | 205569714 | U | 9/2016 |
| CN | 106017897 | A | 10/2016 |
| CN | 205659874 | U | 10/2016 |
| CN | 205704976 | U | 11/2016 |
| CN | 106214447 | A | 12/2016 |
| CN | 106214448 | A | 12/2016 |
| CN | 106264974 | A | 1/2017 |
| CN | 106264975 | A | 1/2017 |
| CN | 106377887 | A | 2/2017 |
| CN | 106457020 | A | 2/2017 |
| CN | 205948012 | U | 2/2017 |
| CN | 106512314 | A | 3/2017 |
| CN | 106546369 | A | 3/2017 |
| CN | 206007563 | U | 3/2017 |
| CN | 206063396 | U | 4/2017 |
| CN | 206138372 | U | 5/2017 |
| CN | 206167337 | U | 5/2017 |
| CN | 206183624 | U | 5/2017 |

(56) References Cited

FOREIGN PATENT DOCUMENTS

| | | | |
|---|---|---|---|
| CN | 106798634 | A | 6/2017 |
| CN | 206335905 | U | 7/2017 |
| CN | 107198649 | A | 9/2017 |
| CN | 206527774 | U | 9/2017 |
| CN | 107374930 | A | 11/2017 |
| CN | 107433011 | A | 12/2017 |
| CN | 206760648 | U | 12/2017 |
| CN | 206777503 | U | 12/2017 |
| CN | 107854296 | A | 3/2018 |
| CN | 108160917 | A | 6/2018 |
| CN | 207520333 | U | 6/2018 |
| CN | 207640645 | U | 7/2018 |
| CN | 207640646 | U | 7/2018 |
| CN | 108464668 | A | 8/2018 |
| CN | 108501103 | A | 9/2018 |
| CN | 207804593 | U | 9/2018 |
| CN | 108635195 | A | 10/2018 |
| CN | 207950142 | U1 | 10/2018 |
| CN | 108720396 | A | 11/2018 |
| CN | 108836800 | A | 11/2018 |
| CN | 208072139 | U | 11/2018 |
| DE | 2130245 | A1 | 12/1972 |
| DE | 2460728 | A1 | 6/1976 |
| DE | 2520420 | A1 | 11/1976 |
| DE | 2559479 | A1 | 1/1977 |
| DE | 2538588 | A1 | 3/1977 |
| DE | 2552195 | A1 | 5/1977 |
| DE | 2649864 | A1 | 5/1977 |
| DE | 2602625 | A1 | 7/1977 |
| DE | 2619193 | A1 | 11/1977 |
| DE | 2642937 | A1 | 3/1978 |
| DE | 2652952 | A1 | 5/1978 |
| DE | 2718205 | A1 | 11/1978 |
| DE | 2732760 | A1 | 2/1979 |
| DE | 2746287 | A1 | 4/1979 |
| DE | 2757272 | A1 | 7/1979 |
| DE | 2807832 | A1 | 8/1979 |
| DE | 2826249 | A1 | 12/1979 |
| DE | 2832290 | A1 | 1/1980 |
| DE | 2833651 | A1 | 2/1980 |
| DE | 2843438 | A1 | 4/1980 |
| DE | 2844014 | A1 | 4/1980 |
| DE | 2904058 | A1 | 8/1980 |
| DE | 2925635 | A1 | 1/1981 |
| DE | 2928565 | A1 | 1/1981 |
| DE | 2934674 | A1 | 3/1981 |
| DE | 3033600 | A1 | 4/1982 |
| DE | 3143640 | A1 | 5/1983 |
| DE | 3725606 | A1 | 2/1989 |
| DE | 3932185 | C1 | 2/1991 |
| DE | 3940452 | C1 | 5/1991 |
| DE | 4003871 | A1 | 8/1991 |
| DE | 4240285 | A1 | 6/1993 |
| DE | 4208419 | A1 | 9/1993 |
| DE | 4217570 | A1 | 10/1993 |
| DE | 4239044 | A1 | 3/1994 |
| DE | 4241639 | A1 | 6/1994 |
| DE | 19525664 | A1 | 1/1997 |
| DE | 19726415 | A1 | 12/1998 |
| DE | 19828950 | A1 | 12/1999 |
| DE | 19839416 | A1 | 3/2000 |
| DE | 10034533 | A1 | 1/2002 |
| DE | 10139821 | A1 | 4/2002 |
| DE | 10046070 | A1 | 6/2002 |
| DE | 10209576 | A1 | 10/2002 |
| DE | 29724693 | U1 | 2/2003 |
| DE | 10320181 | A1 | 12/2004 |
| DE | 202004016610 | U1 | 3/2005 |
| DE | 102004046517 | A1 | 3/2006 |
| DE | 202005017848 | U1 | 3/2006 |
| DE | 102004055833 | A1 | 5/2006 |
| DE | 202006016761 | U1 | 12/2006 |
| DE | 102006037965 | A1 | 2/2008 |
| DE | 102006037966 | A1 | 2/2008 |
| DE | 102006041240 | A1 | 3/2008 |
| DE | 102006061180 | A1 | 6/2008 |
| DE | 102009034827 | A1 | 2/2011 |
| DE | 102009035426 | A1 | 2/2011 |
| DE | 102010023346 | A1 | 4/2011 |
| DE | 102010044274 | A1 | 4/2012 |
| DE | 102011009344 | | 7/2012 |
| DE | 102013011423 | A1 | 4/2014 |
| DE | 102013001545 | A1 | 7/2014 |
| EP | 0901649 | A1 | 3/1999 |
| EP | 2133155 | A1 | 12/2009 |
| EP | 2289636 | A1 | 3/2011 |
| EP | 2775985 | A1 | 11/2012 |
| EP | 2735297 | A2 | 5/2014 |
| EP | 3354251 | A1 | 8/2018 |
| EP | 3409247 | A1 | 12/2018 |
| FR | 1600996 | A | 8/1970 |
| FR | 2285837 | A1 | 4/1976 |
| FR | 2321947 | A1 | 3/1977 |
| FR | 2388968 | A2 | 11/1978 |
| FR | 2391083 | A1 | 12/1978 |
| FR | 2401862 | A1 | 3/1979 |
| FR | 2456470 | A1 | 12/1980 |
| FR | 2461191 | A3 | 1/1981 |
| FR | 2496501 | A1 | 6/1982 |
| FR | 2500374 | A1 | 8/1982 |
| FR | 2698278 | A1 | 5/1994 |
| FR | 2698279 | A1 | 5/1994 |
| FR | 2813198 | A3 | 8/2002 |
| FR | 2820009 | A1 | 8/2002 |
| FR | 2837515 | A1 | 9/2003 |
| FR | 2837516 | A1 | 9/2003 |
| FR | 2840523 | A1 | 12/2003 |
| FR | 2886282 | A1 | 12/2006 |
| FR | 2891763 | A1 | 4/2007 |
| FR | 2905876 | A1 | 3/2008 |
| FR | 2906477 | A3 | 4/2008 |
| FR | 2941645 | A1 | 8/2010 |
| FR | 2967079 | A3 | 5/2012 |
| GB | 2084516 | A | 4/1982 |
| GB | 2346677 | A | 8/2000 |
| JP | S58135062 | A | 8/1983 |
| JP | H3177414 | A | 8/1991 |
| JP | H5133414 | A | 5/1993 |
| JP | H5318497 | A | 12/1993 |
| JP | H5329855 | A | 12/1993 |
| JP | H8332679 | A | 12/1996 |
| JP | H9221245 | A | 8/1997 |
| JP | H11114978 | A | 4/1999 |
| JP | H11147267 | A | 6/1999 |
| JP | H11351240 | A | 12/1999 |
| JP | 200130373 | A | 2/2001 |
| JP | 2001304245 | A | 10/2001 |
| JP | 2001353699 | A | 12/2001 |
| JP | 200270839 | A | 3/2002 |
| JP | 2002113727 | A | 4/2002 |
| JP | 2002115714 | A | 4/2002 |
| JP | 2002172633 | A | 6/2002 |
| JP | 2002179754 | A | 6/2002 |
| JP | 2002301736 | A | 10/2002 |
| JP | 2002337162 | A | 11/2002 |
| JP | 2002355827 | A | 12/2002 |
| JP | 2002361649 | A | 12/2002 |
| JP | 2002361670 | A | 12/2002 |
| JP | 200339449 | A | 2/2003 |
| JP | 200373441 | A | 3/2003 |
| JP | 2003103640 | A | 4/2003 |
| JP | 2003127153 | A | 5/2003 |
| JP | 2003211461 | A | 7/2003 |
| JP | 2003220620 | A | 8/2003 |
| JP | 2003247533 | A | 9/2003 |
| JP | 2003285336 | A | 10/2003 |
| JP | 2003299704 | A | 10/2003 |
| JP | 200417398 | A | 1/2004 |
| JP | 200490430 | A | 3/2004 |
| JP | 2004101635 | A | 4/2004 |
| JP | 2004101715 | A | 4/2004 |
| JP | 2004101716 | A | 4/2004 |
| JP | 2004101717 | A | 4/2004 |
| JP | 2004278603 | A | 10/2004 |

(56) References Cited

FOREIGN PATENT DOCUMENTS

| | | | |
|---|---|---|---|
| JP | 2004354723 | A | 12/2004 |
| JP | 200590627 | A | 4/2005 |
| JP | 2005155870 | A | 6/2005 |
| JP | 2005169915 | A | 6/2005 |
| JP | 2005169916 | A | 6/2005 |
| JP | 2005249040 | A | 9/2005 |
| JP | 2005300666 | A | 10/2005 |
| JP | 2005307030 | A | 11/2005 |
| JP | 200644038 | A | 2/2006 |
| JP | 200658450 | A | 3/2006 |
| JP | 2006178128 | A | 7/2006 |
| JP | 2006184602 | A | 7/2006 |
| JP | 2006264143 | A | 10/2006 |
| JP | 2006326687 | A | 12/2006 |
| JP | 200715116 | A | 1/2007 |
| JP | 2007021120 | A | 2/2007 |
| JP | 200765375 | A | 3/2007 |
| JP | 200785451 | A | 4/2007 |
| JP | 2007132431 | A | 5/2007 |
| JP | 2007145904 | A | 6/2007 |
| JP | 2007170579 | A | 7/2007 |
| JP | 2007262299 | A | 10/2007 |
| JP | 2007293007 | A | 11/2007 |
| JP | 2007316228 | A | 12/2007 |
| JP | 2007316230 | A | 12/2007 |
| JP | 2007316231 | A | 12/2007 |
| JP | 20086074 | A | 1/2008 |
| JP | 200820639 | A | 1/2008 |
| JP | 200858621 | A | 3/2008 |
| JP | 2008161651 | A | 7/2008 |
| JP | 2008221473 | A | 9/2008 |
| JP | 2008275496 | A | 11/2008 |
| JP | 2008280447 | A | 11/2008 |
| JP | 2008280448 | A | 11/2008 |
| JP | 2008295980 | A | 12/2008 |
| JP | 2008307777 | A | 12/2008 |
| JP | 2009109866 | A | 5/2009 |
| JP | 2009113214 | A | 5/2009 |
| JP | 2009139866 | A | 6/2009 |
| JP | 2009162644 | A | 7/2009 |
| JP | 2009273844 | A | 11/2009 |
| JP | 201019332 | A | 1/2010 |
| JP | 2010276952 | A | 12/2010 |
| JP | 2011240587 | A | 12/2011 |
| JP | 201271450 | A | 4/2012 |
| JP | 2012127743 | A | 7/2012 |
| JP | 2012217516 | A | 11/2012 |
| JP | 2012226054 | A | 11/2012 |
| JP | 2012242447 | A | 12/2012 |
| JP | 2013180191 | A | 9/2013 |
| JP | 2013231953 | A | 11/2013 |
| JP | 201418506 | A | 2/2014 |
| JP | 201470161 | A | 4/2014 |
| JP | 201470186 | A | 4/2014 |
| JP | 2014114400 | A | 6/2014 |
| JP | 2014219560 | A | 11/2014 |
| JP | 201533767 | A | 2/2015 |
| JP | 2015125275 | A | 7/2015 |
| JP | 2015127098 | A | 7/2015 |
| JP | 2016137062 | A | 8/2016 |
| JP | 2016203421 | A | 12/2016 |
| JP | 2016209503 | A | 12/2016 |
| JP | 2017196384 | A | 11/2017 |
| JP | 2017223264 | A | 12/2017 |
| JP | 2018146742 | A | 9/2018 |
| KR | 890000792 | Y1 | 3/1989 |
| KR | 20010000453 | U | 1/2001 |
| KR | 0122644 | Y1 | 6/2001 |
| KR | 20010048613 | A | 3/2003 |
| KR | 20060040522 | A | 5/2006 |
| KR | 20060055669 | A | 5/2006 |
| KR | 200434026 | Y1 | 12/2006 |
| KR | 20070075663 | A | 7/2007 |
| KR | 100757732 81 | | 9/2007 |
| KR | 100804314 | B1 | 2/2008 |
| KR | 20100012321 | U | 12/2010 |
| KR | 20100125514 | A1 | 12/2010 |
| KR | 20130003261 | U | 1/2013 |
| KR | 20130004472 | U | 1/2013 |
| KR | 20130083518 | A | 7/2013 |
| KR | 20130117364 | A | 10/2013 |
| KR | 101345830 | B1 | 12/2013 |
| KR | 20140006131 | A | 1/2014 |
| KR | 20140006178 | A | 1/2014 |
| KR | 20140020741 | A | 2/2014 |
| KR | 20150045173 | A | 4/2015 |
| KR | 200477995 | Y1 | 8/2015 |
| KR | 200478339 | Y1 | 9/2015 |
| KR | 20150108100 | A | 9/2015 |
| KR | 101617663 81 | | 5/2016 |
| KR | 20170010943 | A | 2/2017 |
| KR | 20170015730 | A | 2/2017 |
| KR | 20170015731 | A | 2/2017 |
| KR | 20170017052 | A | 2/2017 |
| KR | 101713583 | B1 | 3/2017 |
| KR | 101732176 | B1 | 5/2017 |
| KR | 101748353 | B1 | 6/2017 |
| KR | 101750859 | B1 | 6/2017 |
| KR | 20170086501 | A | 7/2017 |
| KR | 20170100862 | A | 9/2017 |
| KR | 20180103296 | A | 9/2018 |
| KR | 20180111412 | A | 10/2018 |
| KR | 20180111425 | A | 10/2018 |
| KR | 20180111426 | A | 10/2018 |
| KR | 20180119736 | A | 11/2018 |
| NL | 8000643 | A | 9/1981 |
| NL | 8702278 | A | 4/1989 |
| NL | 8702994 | A | 7/1989 |
| NL | 1020048 | C2 | 11/2003 |
| NZ | 204547 | A | 4/1986 |
| NZ | 555957 | A | 10/2010 |
| NZ | 591899 | A | 11/2012 |
| RU | 2011100179 | A1 | 7/2012 |
| SE | 8800121 | L | 7/1989 |
| TW | M530164 | U | 4/1915 |
| TW | M275858 | U | 5/1994 |
| TW | 303674 | U | 4/1997 |
| TW | 339654 | U | 9/1998 |
| TW | 450102 | U | 8/2001 |
| TW | 477225 | U | 2/2002 |
| TW | 200423920 | A | 11/2004 |
| TW | 1381864 | B | 11/2005 |
| TW | M310717 | U | 5/2007 |
| TW | M422413 | U1 | 2/2012 |
| TW | M458966 | U1 | 8/2013 |
| TW | M462618 | U | 10/2013 |
| TW | M477270 | U | 5/2014 |
| TW | M482391 | U | 7/2014 |
| TW | M483789 | U | 8/2014 |
| TW | M484424 | U | 8/2014 |
| TW | M503894 | U | 7/2015 |
| TW | M505294 | U | 7/2015 |
| TW | M508316 | U | 9/2015 |
| TW | M510180 | U | 10/2015 |
| TW | M513023 | U1 | 12/2015 |
| TW | M514320 | U | 12/2015 |
| TW | M519526 | U | 4/2016 |
| TW | M519531 | U | 4/2016 |
| TW | M528168 | U | 9/2016 |
| TW | M528745 | U | 9/2016 |
| TW | M533984 | U | 12/2016 |
| TW | M540667 | U | 5/2017 |
| TW | M543689 | U | 6/2017 |
| TW | M545612 | U | 7/2017 |
| TW | M546217 | A | 8/2017 |
| TW | M546217 | U | 8/2017 |
| TW | M546816 | U | 8/2017 |
| TW | M547385 | U | 8/2017 |
| TW | M556150 | U | 3/2018 |
| TW | M557121 | U | 3/2018 |
| TW | 201818902 | A | 6/2018 |
| TW | 201822842 | A | 7/2018 |
| TW | M565566 | U | 8/2018 |
| UA | 36632 | U | 10/2008 |

(56) References Cited

FOREIGN PATENT DOCUMENTS

| | | | |
|---|---|---|---|
| WO | 9700102 | A1 | 1/1997 |
| WO | 2005082105 | A2 | 9/2005 |
| WO | 2012174553 | A1 | 12/2012 |
| WO | 2014019305 | A1 | 2/2014 |
| WO | 2014201120 | A | 12/2014 |
| WO | 2015101371 | A1 | 7/2015 |
| WO | 2015123207 | A1 | 8/2015 |
| WO | 2016184444 | A1 | 11/2016 |
| WO | 2017215597 | A1 | 12/2017 |
| WO | 2018098293 | A1 | 5/2018 |
| WO | 2019020066 | A1 | 1/2019 |
| WO | 2019022025 | A1 | 1/2019 |
| WO | 2019040945 | A1 | 2/2019 |
| ZA | 201106711 | B | 8/2012 |

OTHER PUBLICATIONS

Google 26 page list of 850+ relevant products uncovered using the expression “foam roller” (Exhibit A).
Google 26 page list of 850+ relevant products uncovered using the expression “massage foam” (Exhibit B).
Google 17 page list of 500+ relevant products uncovered using the expression “oblong foam roller” (Exhibit C).

* cited by examiner

MULTI-ZONAL ROLLER AND METHOD OF USE THEREOF

TECHNICAL FIELD

The present invention generally relates a multi-zonal and non-circular roller with several different zones along the periphery of the roller's outer surface and more specifically a roller having a non-circular internal area, a non-regular external surface covered by a series of multiple shape and angles designed to include to offer a user different types of resistance and muscle relief, including a point for the management of a myofascial trigger point.

BACKGROUND

Health is a key component of life. Humans understand that several parameters have a positive effect one a person's overall health. These include, for example, the reduction in stress, proper diet, companionship, and regular exercise. This invention is designed to improve health by Exercise is linked with the powering of muscles and often pushing the body and its muscles for a short or long period. While exercise often has a positive effect, it also must be carefully weighted to avoid complications.

To list a problem with exercises, we begin with Delayed-Onset Muscle Soreness (DOMS) which usually peaks 48 to 72 hours after a workout. A body and its muscles goes to work on the process of reparation of muscle fibers that were torn or damaged during exercise which results in a varying degree of pain depending on how much damage has been done. DOMS prevents a person from engaging in a routine of exercise needed to improve or maintain health up to a week after exercise. For example, DOMS can be felt by occasional marathon runners finishing their first race. What is needed is a tool or method of using a tool which is designed to help reduce secondary effects of DOMS.

In addition, intensive or even occasional exercise and physical activity by someone new to the field of exercise also results in what is pain or something called Muscle Fatigue. Muscle fatigue results from a shortage of fuel (substrates) within the muscle fiber or the accumulation of substances (metabolites) within the muscle fiber which interferes with the release of calcium or with the ability of calcium to stimulate muscle contraction. This effect is easily felt by a person biking up a mountain. Initially, the legs feel powerful but with time, fatigue sets in and can feel like a person is pushing as hard without getting the desired result. What is needed is a tool or a method of using a tool designed to limit muscle fatigue or to help recover quicker from fatigue.

In parallel, stretching of muscles is known to have beneficial effects before exercise as it warms up a muscle and after exercise to avoid risk of injury and increase performance. Stretching is the subject of multiple controversy and debate as how to optimize or quantify its positive effects over the body. It appears that most individuals and most bodies react differently to pre and post effort stretching. To some, stretching after effort results in a quicker return to full power. To other, stretching before exercise avoids muscle damage or rupture. In 2013, a study even suggested that active dynamic warmups might be recommended before exercise in place of static stretching.

Stretching tools include the foam roller, the stretch band, flex cushions, or even balance balls or half balls. Foam rollers are lightweight, cylindrical tubes of compressed foam used generally by placing a portion of the body over the roller and by moving horizontally the body portion. The movement (back and forth) results in gravity creating an upward force on the muscle at a different position. The goal is often to move the body member (e.g. leg) from the upper portion of the muscle to the lower portion of the muscle. Rollers come in different sizes and degrees of firmness. Often, a color is used to identify the firmness ranging from soft (beginner) to firm.

Foam rollers are part of "tool-assisted self-manual therapy" acting on the myofascial release system. Research has shown that regular self-myofascial release may be able to increase flexibility long-term in users when programs last more than two weeks. Self-myofascial release may reduce perceived soreness and increase pressure pain threshold as a result of DOMS during the period following exercise.

Multiple rollers exist in the prior art. For example, U.S. Pat. No. 7,918,774 titled Therapeutic Fitness and Sports Enhancement Device to inventor Dye. This product shows a series of non-hollow tubes of foam each having a set of regularly spaced ridges on the outside surface of the tube. This technology allows cyclical strain to be placed on the muscle along a horizontal movement of the body. The fully circular shape of the roller also simplifies the movement by a person allowing the body portion to remain on a horizontal plane during the entire back and forth movement.

U.S. Pat. No. 9,345,921 also to Mr. Dye offers a method of manufacturing and using the product described in his earlier patent for action on the quadriceps, the iliotibial band, the inner thigh, the glutes, the *piriformis*, hamstrings, the lumbar region, rhomboids, to conduct a thoracic extension, for use in the thoracic region, for use on the shins, the calf, the side of neck, the upper neck, the upper trapezius, the shoulder and rotator cuff, the rhomboids, the lower back, the arch of foot, and the heel of Achilles. The inventor also included end-caps in one embodiment and a small central opening along the length of the tube where a handle is placed. The handle is designed to be gripped at both ends of the roller to allow a user to use manual force on the muscle of choice instead of gravity force (i.e. by pushing down the roller on the muscle instead of pushing the muscle down on the roller).

All of the art linked with "rollers" is designed around a notion of cylindricality and circumferential uniformity. All "rollers" with no exception are designed to be rolled over a surface and over the body. Around the periphery of the "roller" similar structure exists and is found and the user may use it irrespective of its orientation on the floor. What is needed is a "roller" designed to increase the capacity to work effectively on different portions of muscles of a user and also a "roller" able to adapt to different types based on that user's specific daily needs.

SUMMARY

The present invention relates generally to a new non-circular object with an a multi-zonal peripheral arrangement where the roller having a non-regular internal area, a non-regular external surface and a peripheral shape designed to include a point for myofascial trigger point management and several other zones for active work. The roller in one embodiment has several circumferential zones, each covering about ⅓ of the peripheral length for use in one of the three areas. In another embodiment, the interface between two of these zones also creates a curvature point having additional properties. One of these curvature points is an additional zone for the treatment of myofascial trigger points.

DETAILED DESCRIPTION

The current invention is one described as part of the field of health and rehabilitation of muscles linked often with exercise and/or other trauma. The description shows and uses terminology linked with products generally found in modern gyms. But while one type of technology is described using one vehicular, one of ordinary skill in the art will understand this technology can also be use in medical centers and rehabilitation centers to help patients return to full health or to help alleviate pain.

Figure 1:
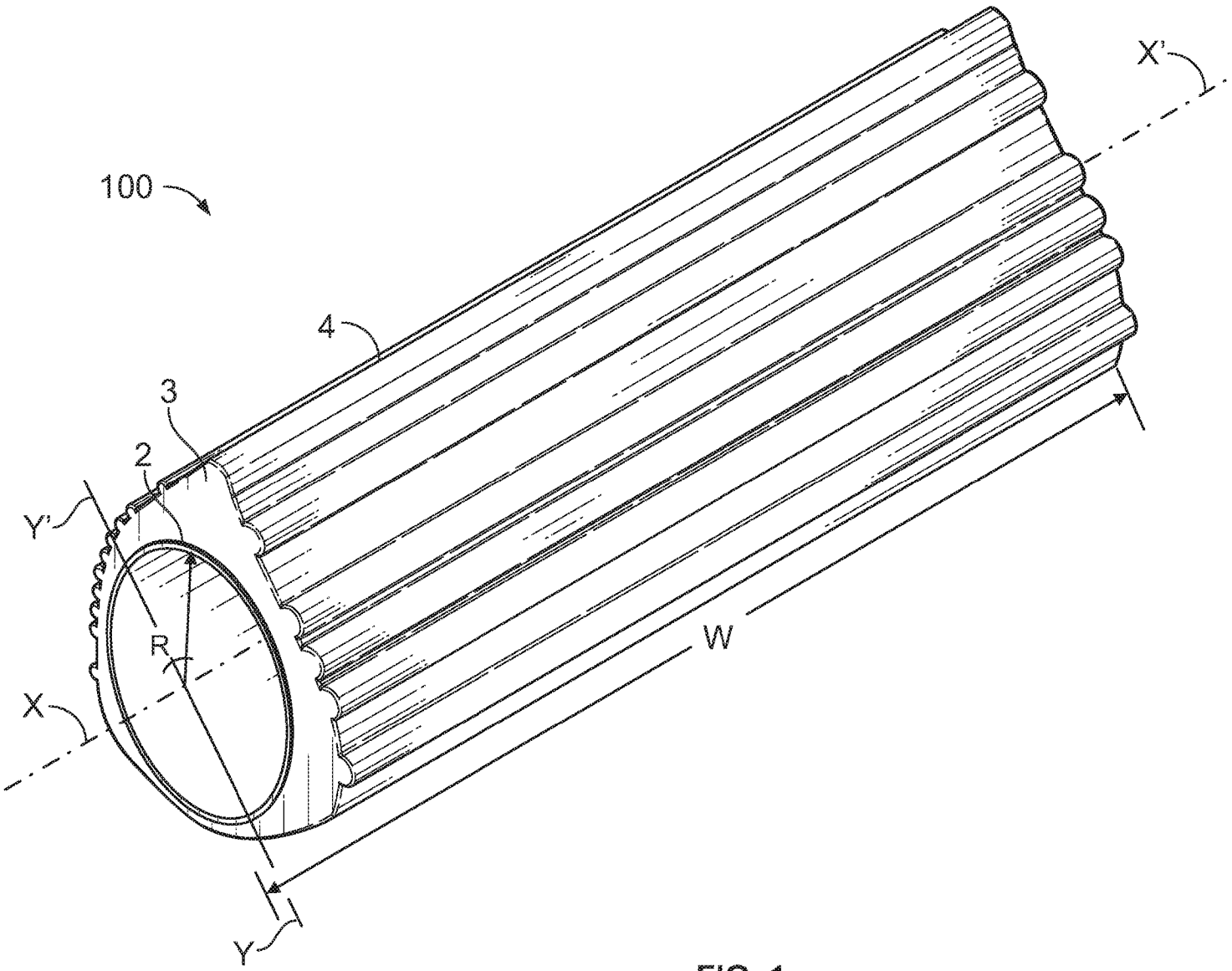
FIG. 1 an isometric view of the roller according to an embodiment of the present disclosure.

FIG. 1, shows generally an isometric side view of Roller 100. While the shape is generally irregular and explained with greater clarity below, one of ordinary skill can generally use a three-dimensional coordinate system that includes the width (W) of the Roller 100, a radius (R) that generally defines the distance from a central axis (X-X') as illustrated. Finally, to described with great precision the exact location along the circumference (internal or external) of the Roller 100, the inventor uses an Angle (φ) having as a reference the plan view (Y-Y') shown at FIG. 1.

As shown the Roller 100 is of a width (W) sufficient for a portion of the body to be placed thereon, as shown the Roller 100 be at least 10-24 inches. While one of ordinary skill in the art observes a Roller 100 with a width as shown, what is contemplated is any length which allows for a portion of the human body to rest against the Roller 100, from one sufficient to only house an arm to one of sufficient length to house the thorax of an individual. In an alternate embodiment, the width is only 4-7 inches when designed for individual portions of the human body like an arm or a leg instead of the torso.

The Roller 100 is illustrated using a variable internal radius (RI) and a variable external radius (RX) which as shown while variable along the Angle (φ), does not change along the width (W). In one anticipated mode of fabrication, the shape is extruded using a simple die/push cast. The Roller 100, when in need of skeletal support strength may include an inner tube 2 made of a rigid yet somewhat pliable polymer which is designed to help support and give structure to the Roller 100. In the preferred embodiment, the tube 2 is glued onto the external shell 3. In another embodiment, the tube 2 is slipped inside by expanding the external shell 3 temporarily and assembled simply by allowing the external shell 3 to contract and return to form. Both tube 2 and external shell 3 can be made of several known plastics, for example, injected molded plastics. In one embodiment an EVA-TPR (Ethylene Vinyl Acetate copolymer/ThermoPlastic Rubber or Elastomer). In another embodiment, the tube 2 is made of Polypropylene of 3 mm think and includes small finds to help give traction between the tube 2 and the external shell 3 on the outside surface.

Figure 2:
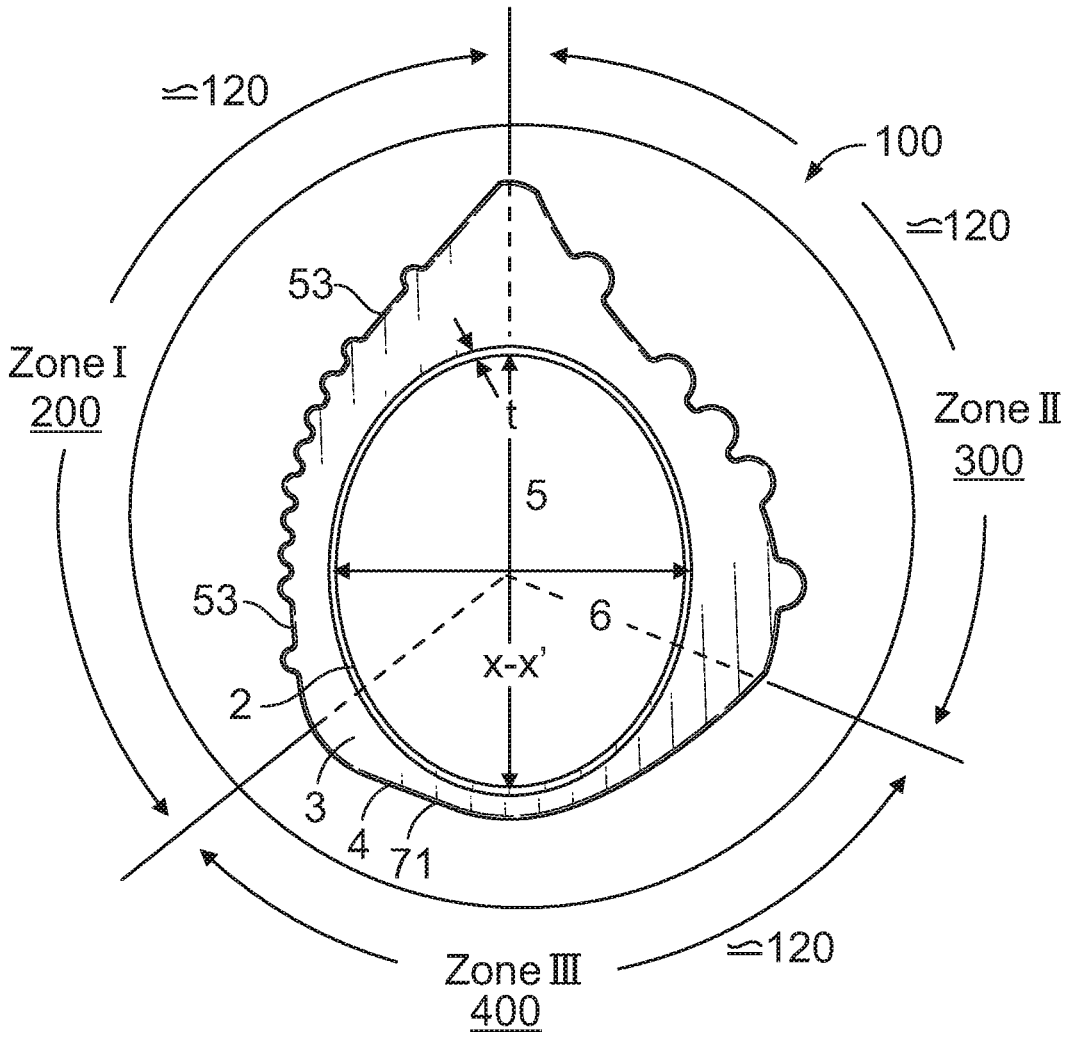
FIG. 2 is a side view along axis X-X' of the roller as shown at FIG. 1 according to an embodiment of the present disclosure.
Figure 3:
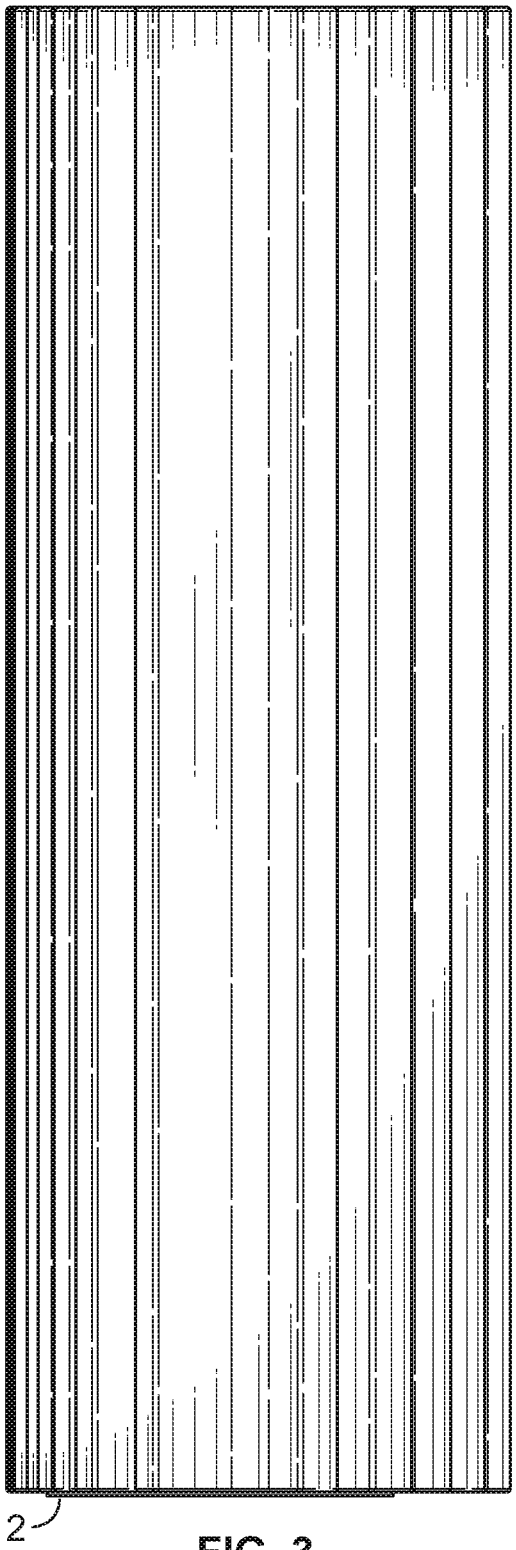
FIG. 3 is a front view of the roller as shown at FIG. 1 according to an embodiment of the present disclosure.
Figure 4:
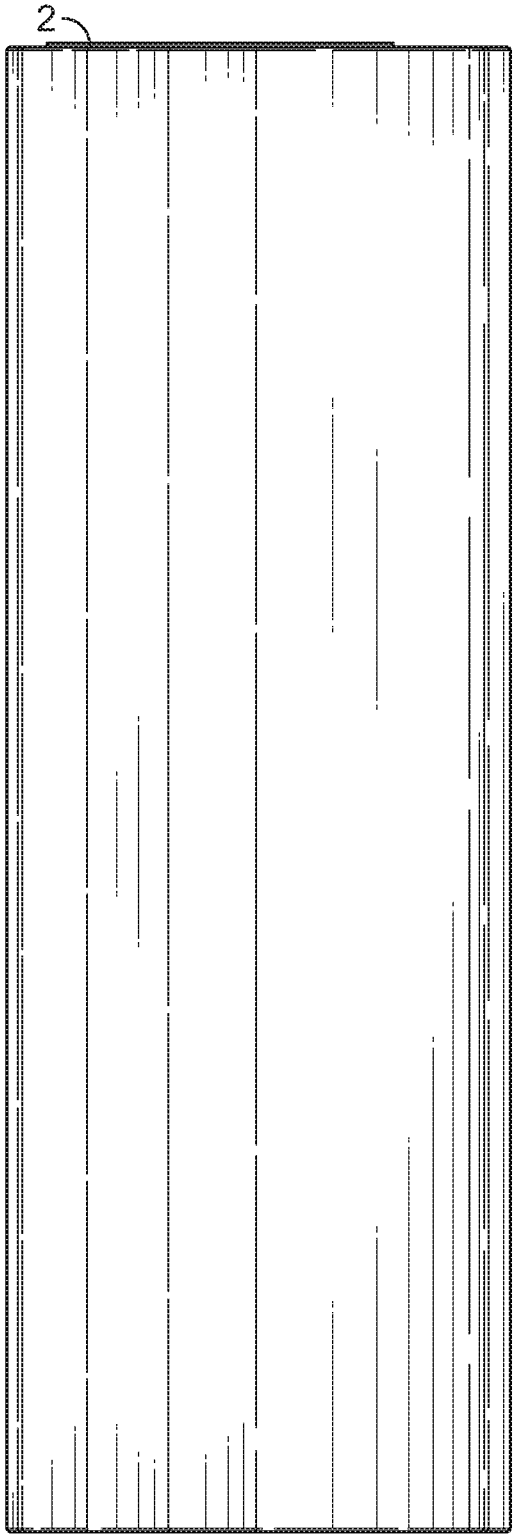
FIG. 4 is a back view of the roller as shown at FIG. 1 according to an embodiment of the present disclosure.

The inner tube 2 can be made of thermoplastic for example made of acrylic, ABS, Nylon, PLA, Polybenzimidazole, Polycarbonate, Polyether sulfone, Polyoxymethylene, Polyetherether ketone, Polyetherimide, Polyvinyl chloride, Teflon, Polyvinylidene fluoride, Polypropylene or the like. As shown at FIG. 2 with greater clarity, the inner tube 2 can have a regular thickness (t) along its full circumference even if the internal radius of the inner tube surface 3 can be irregular in its distance to the axis X-X'. The Roller 100 as shown at FIG. 2 shows the product in one orientation where the vertical distance 5 of the inner tube 2 is longer than the horizontal distance 6 of the inner tube 2. In one embodiment, the ratio of the vertical distance over the horizontal distance is in the range of 1.05 to 1.15. In another embodiment, the ratio can reach 1.15 to 1.40. What is not shown bot also contemplated is where ¾ of the inner tube 2 is circular and only the upper third is expanded upward. In that case, the ratios can be lowered to 1.025 to 1.075. In one embodiment, the thickness of the tube (t) is a range between 2-5 mm. In another embodiment, the tube thickness can be between $1/8^{th}$ to $1/4^{th}$ of an inch under the English unit model. While certain thicknesses have been given, what is contemplated is the use of any tube having sufficient rigidity to meet its purpose of allowing the outer external shell 3 to offer its purpose of support to a user. In one embodiment, a surface protective flexible layer 4 can be added to the outside of the external shell 3 to offer the roller additional properties such as being germ resistant or having a different surface roughness.

Figure 6:
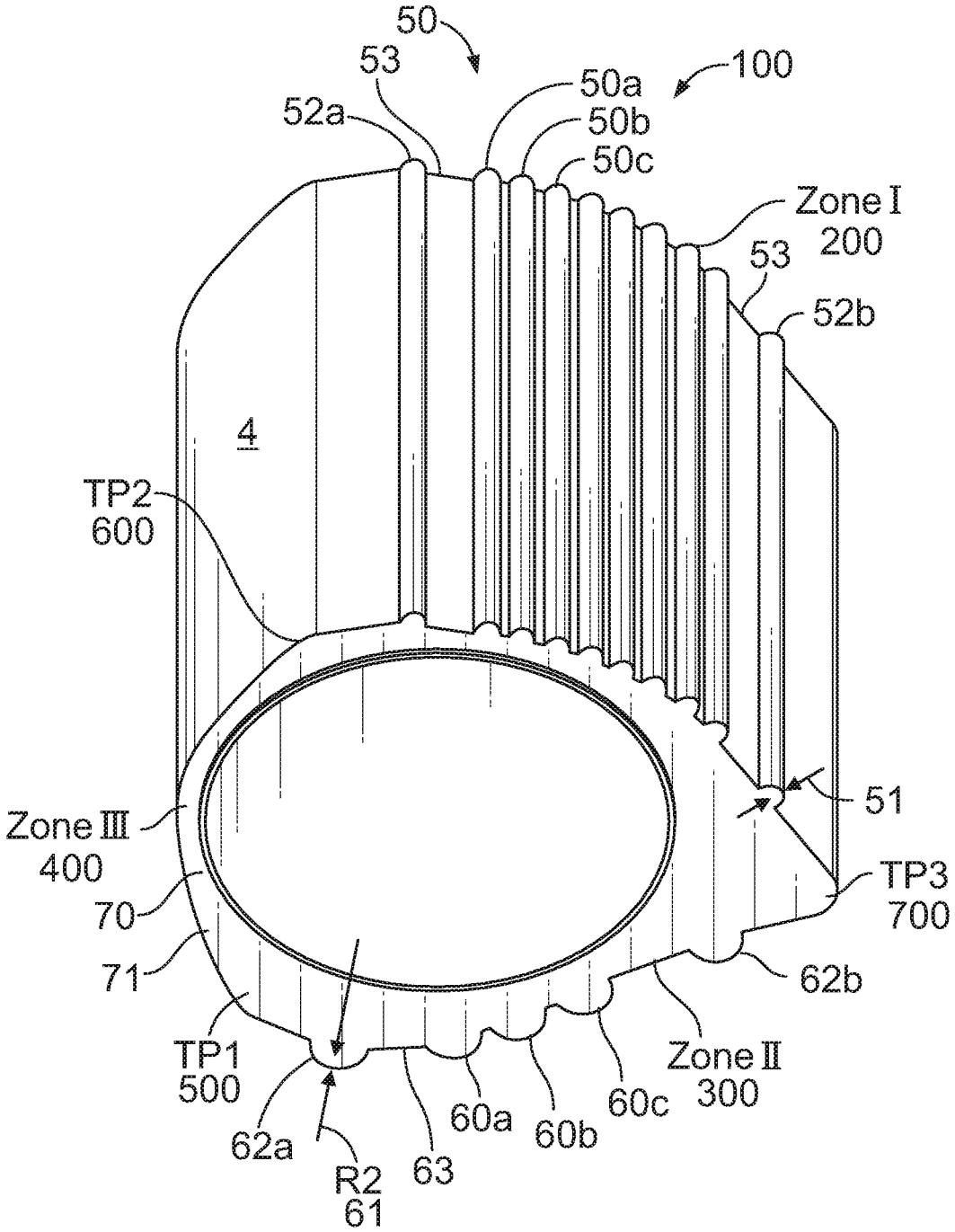
FIG. 6 is an isometric view of the roller as shown at FIG. 5 with Zone I in the foreground according to the second embodiment of the present disclosure.
Figure 7:
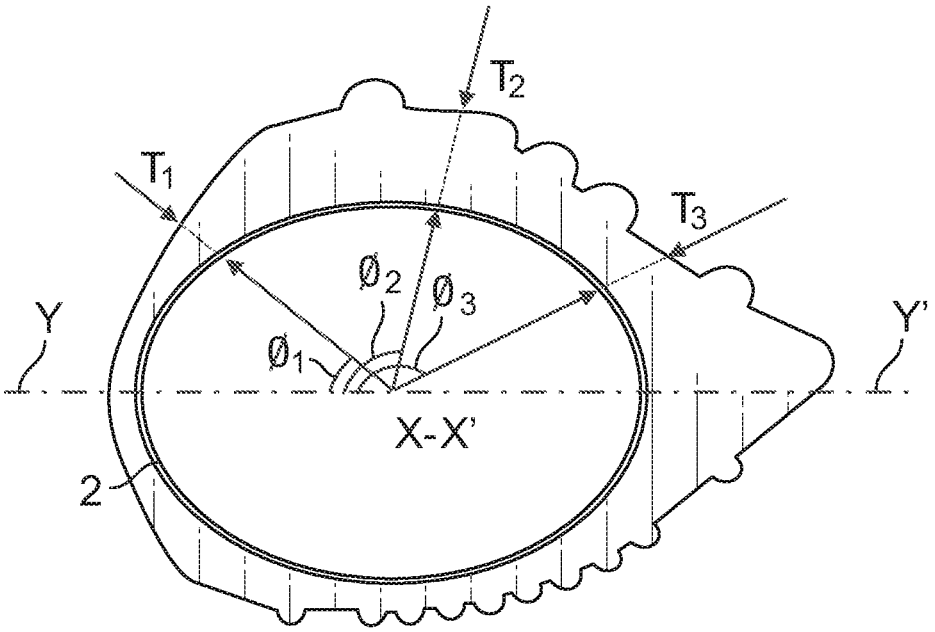
FIG. 7 is a cut view along axis A-A as shown at FIG. 5 according to an embodiment of the present disclosure.
Figure 8:
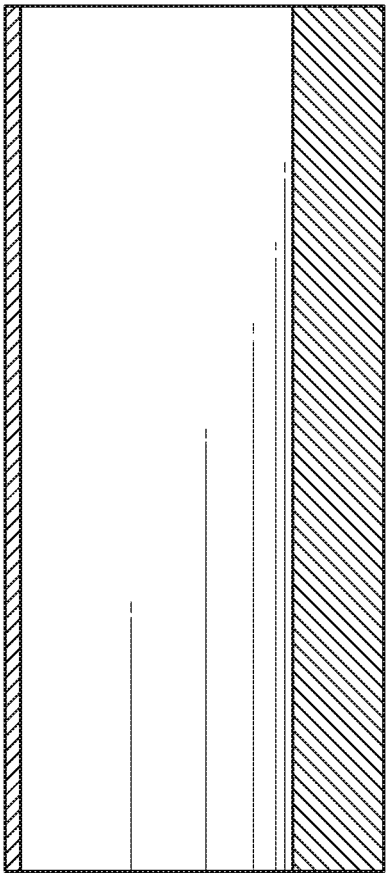
FIG. 8 is a cut view along axis B-B of the external shell as shown at FIG. 5 according to an embodiment of the present disclosure.

Surrounding the inner tube 2 is a compressible external shell 3 thickness of variable radial thickness (T) shown as T1, T2, and T3 on FIG. 7 around the Angle (φ) shown φ1, φ2, φ3 as from the central axis X-X'. Returning to FIG. 2, generally speaking three 'zones' named Zone I 200, Zone II 300, and Zone III 400, are offered for use to users. Each zone takes generally about 120 degree from the axis X'X' creating three zones of similar size. As shown at FIG. 6, at the apogee (i.e. the other side) of the central region of each Zone I, II, and III, is a Tip Point shown at TP1 500, TP2 600, and TP3 700. TP1 is place at the apogee of Zone I, TP2 is illustrated at the apogee of Zone II, and TP3 is shown as the apogee of Zone III.

The polymeric foam of the external shell 3 also known as a foam can be made of a polymer having internal bubbles of air or air structure to give the polymer a soft feeling to the touch and in some case allowing the polymer to greatly deform and bounce back slowly with time (a couple of seconds). General foams used for contact with the human skin include foams able to deform and return after pressure has been stopped to their original form. For example, ethylene-vynil acetate (EVA) foam, low-density polyethylene (LPDE) foam, nitrile rubber (NBR) foam, polychloroprene foam, polyimide foam, polypropylene (PP) foam, polystyrene (PS) foam, Styrofoam, polyurethane (PU) foam, polyethylene foam (PEF), polyvinyl chloride (PVC) foam or silicone foam. Foam is generally defined by both a density (weight per unit of volume). For most polyfoams, a low-density range is less than 1.5 PCF. The medium-density range is from 1.5 to 1.7 PCF and the high-density range is more than 1.7 PCF. Firmness is measure on a scale of 1 to 10 where 1 is the softest and 10 is the firmest and firmness. One of ordinary skill will understand the possibilities and possible variations linked with alternating and changing the density of the foam. For example, the shell 3 could be made of different zones having different density. While the current contemplated embodiment includes a single shell with uniform density foam, one may understand for example that Zone 3 400 and TP3 600 designed for a lower level of compression and a greater rigidity. As described above, in cases where different density segments are used, may be manufactured using injection or assembly via thermal movement but may also be manufactured using glued EVA sheets layered over the tube 2 then cured using a heat tunnel. Such layers would be selected to modulate and change the effective total density of the segment and could be compression molded or injection molded. Other methods of manufacturing include the use of the tube 2 with a flat layer of EVA followed by a compression molding to alter the outer use diameter. Thermoplastics with memory also may be used.

Description of Zones I, II, and III and Tip Points 1, 2, and 3

As shown at FIG. 6, Zone I 200 is made of a series of small semi-circular bumps 50 with a radius RI 51 around 2-4 mm. The distance between two subsequent bumps 50*a*, 50*b*, 50*c* is about three times RI 51 or about 6-12 mm. As shown, eight bumps 50 are place in the central portion of Zone I 200 and are flanked by two more bumps 52*a*, 52*b* to define a flat portion 53 between the bumps 50 and the bumps 52. To better view the flatness of flat portion 53, this is illustrated at FIG. 2. Returning to FIG. 6, the goal of the side bumps 52*a* is to create a flat area formed by 50*a* and 52*a* with the distance 53. When Zone I 200 is put upward for use against a portion of the human body, the other side's TP1 Tip Point 500 must be placed in equilibrium against the floor. A person will rock the leg over the bumps 50 back and forth. When the product is then used with the TP1 Tip Point 500 upwards and the other side Zone I 200 against the ground, the movement of the leg against the TP1 Tip Point 500 will feel by a balancing movement the bumps 50. The two side bumps 52*a* will then provide a guide to help a user delineate where Zone I 200 starts and stops. Zone I 200 as shown includes a series of 8 central bumps 50 and two side bumps 52.

Zone II 300 is rather analogous to Zone I 200 in that it is made of somewhat larger series of semi-circular bumps 60 with a radius RII of 4-8 mm. The same way as Zone I 200, distance between two subsequent bumps 60*a*, 60*b*, 60*c* is about three times RII 61 or about 18-36 mm. As shown, three bumps 60 are place in the central portion of Zone II 300 and are flanked by two more bumps 62*a*, 62*b* to define a flat portion 63 between the bumps 60 and the bumps 62. The goal of the side bumps 62*a* is to create a flat area formed by 60*a* and 62*a* with the distance 63. When Zone II 300 is put upward for use against a portion of the human body, the other side's TP2 Tip Point 600 must be placed in equilibrium against the floor. A person will rock the leg over the bumps 60 back and forth. When the product is then used with the TP2 Tip Point 600 upwards and the other side Zone II 300 against the ground, the movement of the leg against the TP2 Tip Point 600 will feel by a balancing movement the bumps 60. The two side bumps 62*a* will then provide a guide to help a user delineate where Zone II 300 starts and stops. Zone II 300 as shown includes a series of 3 central bumps 60 and two side bumps 62.

Zone III 400 is completely different in that it is mostly flat 70 and includes a semi-straight area 71 once again to allow the Roller 100 to reset with stability on the ground with TP3 Tip Point 600 in the highest of position. As shown, Zone III 400 is the thinnest of the three zones Zone I 200, Zone II 300 and Zone III 400. The thin layer as shown is around 6-12 mm thick or about 2-3 times the thickness of the tube 2. Returning to the description of the TP3 Tip Point 600, as shown the tip includes a semi-rounded point 75 with a flat side 76 leading onto Zone I 200 and a slightly curved side 77 leading into Zone II 300. As shown, the thickness of Tip Point 600 is 5-10 times the thickness of the thickness of Zone III 400.

Written simply, the invention is a multi-zonal roller 100 for therapeutic, fitness, and sports enhancement device. It comprises a thin-walled tube 2 with a thickness (t), a width (W), and an outside surface (not numbered) and an external shell 3 of soft polymer with an internal surface as shown at FIG. 1 in contact with the outside surface of the thin-walled tube 2.

The external shell 3 as shown has a variable thickness T1, T2, and T3 as shown at FIG. 7, defining an outer surface of use for therapeutic, fitness, and sports enhancement by contact with a user body (not shown). The variable thickness circumferentially defines a plurality of use zones shown at FIG. 2 as Zone I 200, Zone II 300, and Zone III 400 each opposite along the circumference of a tip point shown as TP1 500, TP2 600, and TP3 700 at FIG. 6.

The thin-walled (t) tube 2 is generally oblong as shown at FIG. 2. One of the two oblong axis 5, 6 may be longer than the other by a ratio of 1.05 to 1.40. The external shell includes three tip points TP1 500, TP2 600, TP3 700 and the plurality of zones Zone I 200, Zone II 300, and Zone III 400 include three zones each covering approximately 120 degree circumferentially of the roller and wherein the each zone is delimited by two of the three tip points as shown at FIG. 2.

The first zone (Zone I 200) is defined by a series of small semi-circular central longitudinal bumps 50*a*, 50*b*, 50*c*, . . . . along the width (W) of the roller 100 and flanked by two more longitudinal bumps 52*a*, 52*b* of identical geometry at a distance along the first zone to create a first flat portion between the small semi-circular central bumps and the flanking bumps 53. The second zone (Zone II 300) is defined by a series of larger semi-circular central longitudinal bumps 60*a*, 60*b*, 60*c*, along the width (W) of the roller 100 and flanked by two more longitudinal larger bumps 62*a*, 62*b* as shown at FIG. 6 of identical geometry as the larger semi-circular central longitudinal bumps at a distance along the second zone 300 to create a second flat portion 63 between the larger semi-circular central longitudinal bumps 60 and the flanking bumps 62.

Figure 5:
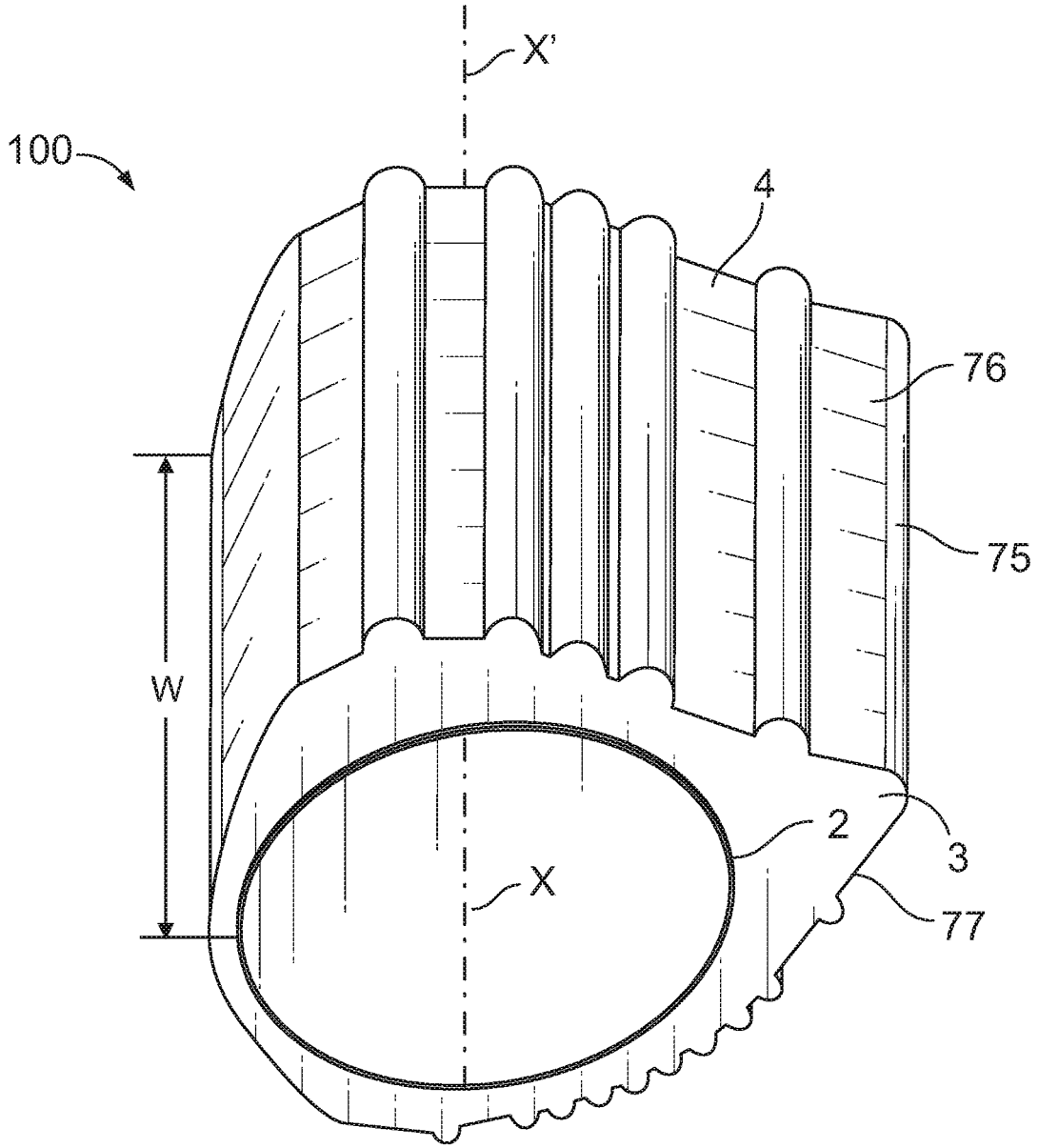
FIG. 5 is an isometric view showing Zone II in the foreground of a short width version of the roller as shown at FIG. 1 according to a second embodiment of the present disclosure.

As shown at FIG. 6, a third zone (Zone III 400) is defined by a third flat area 70 with a semi-straight area 71. At least one of the three tip points TP3 700 includes a semi-rounded point 75 as shown at FIG. 5 with a flat side 76 on one side leading to one of the three zones and a flat side 77 on the other side leading to another of the three zones. The soft polymer forming the external shell 3 of each of the three zones (Zone I, Zone II, and Zone III) may have a different density (not illustrated).

What is also contemplated is method of use of a multi-zonal roller 100 for therapeutic, fitness, and sports enhancement device, the method comprising the steps of: selecting a multi-zonal roller as described above, placing on the ground at least one of the tip points; contacting a portion of a user's body against one of the zone at the opposite side of the roller, and pivoting around the tip point the roller by moving the user's body as to allow the zone to contact the user's body.

Exemplary embodiments are described and shown above. It is, however, expressly noted that these exemplary embodiments are not limiting, but rather the intention is that additions and modifications to what is expressly described herein also are included within the scope of the present implementation. Moreover, it is to be understood that the features of the various embodiments described herein are not mutually exclusive and can exist in various combinations and permutations, even if such combinations or permutations are not made express herein, without departing from the spirit and scope of the present invention.

In one contemplated embodiment, the assembly process of the tube 2 and the external shell 3 can include the use of a high temperature and/or compressed air to help the foam expand during the assembly and return to tighten with the surface when cold. The use of the outside diameter fins (not shown) on the outside diameter of the tube 2 helps create a greater amount of friction. In the event thermal constriction is used to close the gap between the tube 2 and the external shell 3, the use of any adhesive may not be required.

What is also contemplated is the use of vibration technology inside of the tube 2, a smaller travel version, the use of a thermal element to create hot and cold areas (e.g. via slide in pads or low current and rechargeable batteries. Also, the use of end caps or other bags and carry items for the movement of the product is contemplated.

Since certain changes may be made without departing from the scope of the present implementation, it is intended that all matter contained in the above description or shown in the accompanying drawings be interpreted as illustrative and not in a literal sense. Practitioners of the art will realize that the sequence of steps and architectures depicted in the figures may be altered without departing from the scope of the present implementation and that the illustrations contained herein are singular exemplar examples of a multitude of possible depictions of the present implementations.

What is claimed is:

1. A multi-zonal roller for therapeutic, fitness, and sports enhancement device, comprising:

a thin-walled tube with a thickness, a width, and an outside surface; and an external shell of soft polymer with an internal surface in contact with the outside surface of the thin-walled tube, wherein the external shell has a variable thickness defining an outer surface of use for therapeutic, fitness, and sports enhancement by contact with a user body, wherein the variable thickness circumferentially defines a plurality of zones each opposite along the circumference of a tip point;

wherein the external shell includes three tip points and the plurality of zones includes three zones each covering approximately 120 degree circumferentially of the roller and wherein each zone is delimited by two of the three tip points; and wherein a first zone is defined by a series of small semi-circular central longitudinal bumps along the width of the roller and flanked by two more longitudinal bumps of identical geometry at a distance along the first zone to create a first flat portion between the small semi-circular central bumps and the flanking bumps.

2. The multi-zonal roller of claim 1, wherein the thin-walled tube is generally oblong.

3. The multi-zonal roller of claim 2, wherein one of the two oblong axis is longer than the other by a ratio of 1.05 to 1.40.

4. The multi-zonal roller of claim 1, wherein a second zone is defined by a series of larger semi-circular central longitudinal bumps along the width of the roller and flanked by two more longitudinal larger bumps of identical geometry as the larger semi-circular central longitudinal bumps at a distance along the second zone to create a second flat portion between the larger semi-circular central longitudinal bumps and the flanking bumps.

5. The multi-zonal roller of claim 4, wherein a third zone is defined by a third flat area with a semi-straight area.

6. The multi-zonal roller of claim 1, wherein at least one of the three tip points includes a semi-rounded point with a flat side on one side leading to one of the three zones and a flat side on the other side leading to another of the three zones.

7. The multi-zonal roller of claim 1, wherein the soft polymer forming the external shell of each of the three zones has a different density.

8. A method of use of a multi-zonal roller for therapeutic, fitness, and sports enhancement device, the method comprising the steps of:

selecting a multi-zonal roller comprising of a thin-walled tube with a thickness, a width, and an outside surface, and an external shell of soft polymer with an internal surface in contact with the outside surface of the thin-walled tube, wherein the external shell has a variable thickness defining an outer surface of use for therapeutic, fitness, and sports enhancement by contact with a user body, wherein the variable thickness circumferentially defines a plurality of zones each opposite along the circumference of a tip point, wherein the external shell includes three tip points and the plurality of zones includes three zones each covering approximately 120 degree circumferentially of the roller and wherein the each zone is delimited by two of the three tip points, wherein a first zone is defined by a series of small semi-circular central longitudinal bumps along the width of the roller and flanked by two more longitudinal bumps of identical geometry at a distance along the first zone to create a first flat portion between the small semi-circular central bumps and the flanking bumps;

placing on the ground at least one of the tip points;

contacting a portion of a user's body against one of the plurality of zones at the opposite side of the roller; and pivoting around the tip point the roller by moving the user's body as to allow the zone to contact the user's body.

9. The method of claim 8, wherein the thin-walled tube is generally oblong.

10. The method of claim 9, wherein the device includes structure where one of the two oblong axis is longer than the other by a ratio of 1.05 to 1.40.

11. The multi-zonal roller of claim 8, wherein a second zone is defined by a series of larger semi-circular central longitudinal bumps along the width of the roller and flanked by two more longitudinal larger bumps of identical geometry as the larger semi-circular central longitudinal bumps at a distance along the second zone to create a second flat portion between the larger semi-circular central longitudinal bumps and the flanking bumps.

12. The method of claim 11, wherein a third zone is defined by a third flat area with a semi-straight area.

13. The method of claim 12, wherein at least one of the three tip points includes a semi-rounded point with a flat side on one side leading to one of the three zones and a flat side on the other side leading to another of the three zones.

14. The method of claim 8, wherein the soft polymer forming the external shell of each of the three zones has a different density.

* * * * *